US005134821A

United States Patent [19]

Sadahiro

[11] Patent Number: 5,134,821

[45] Date of Patent: Aug. 4, 1992

[54] TRUSSED STRUCTURE

[75] Inventor: Osamu Sadahiro, Tokyo, Japan

[73] Assignee: Shimizu Construction Co., Ltd., Tokyo, Japan

[21] Appl. No.: 583,602

[22] Filed: Sep. 17, 1990

[30] Foreign Application Priority Data

Sep. 19, 1989 [JP] Japan ..... 1-242487

[51] Int. Cl.[5] ..... E04B 1/24

[52] U.S. Cl. ..... 52/223 R; 52/644; 52/641; 52/86; 52/639

[58] Field of Search ..... 52/223 R, 639, 640, 52/641, 642, 644, 86

[56] References Cited

U.S. PATENT DOCUMENTS 4,697,397 10/1987 Okuda et al. ..... 52/223

*Primary Examiner*—David A. Scherbel
*Assistant Examiner*—Wynn E. Wood
*Attorney, Agent, or Firm*—Kane, Dalsimer, Sullivan, Kurucz, Levy, Eisele and Richard

[57] ABSTRACT

A trussed structure includes at least a pair of parallel trussed girders. In one of the trussed girders, an upper chord member and a lower chord member are joined through lattice members. The trussed structure includes at least a pair of prestressing members spanning between the opposite sides of the trussed structure. The central portions of the prestressing members are disposed below the end portions of the prestressing members, and connected to the lower chord members so as to pull the lower chord members upwardly. The central portions of both of the prestressing members are disposed between the adjacent trussed girders.

7 Claims, 4 Drawing Sheets

TRUSSED STRUCTURE

BACKGROUND OF THE INVENTION

The present invention relates to a trussed structure, which may be preferably utilized for a long span roof framing of a building.

For long span roof framings, there are conventionally various structures used such as a trussed structure, shell structure, suspended structure, and pneumatic structure.

As prior art for the present invention, Japanese Patent Application No. 60-175997 (Publication No. 6237449), U.S. Pat. No. 4,697,397, and European Patent No. 0211671 are quoted. (The U.S. and European Patents are based on the Japanese Application.) The trussed girder in the patents enables to reduce its own weight and to cause relatively small deflection, so that cost performance is enhanced.

However, the trussed girder presents the following problems:

(1) Pre-tensioned steel cables are disposed along chord members. Therefore, it is very difficult, due to geometrical considerations, to fix the steel cables to desirable positions so that it will not cause a twisting force along the central axis of mass of the chord member in a case where the central axis of the chord member is inside the chord member.

(2) In order to fix the pre-tensioned steel cables to ends of the chord members, the cross-section of the ends are necessarily large.

(3) The out-of-plane strength is not sufficiently high in the trussed girder. If the span is larger than 50–60 m, it is difficult to first construct the whole structure on the ground and then move it into a subject position by a crane because of low buckling resistance.

(4) A continuous bending moment does not exist in supporting columns in the trussed girder. However, a large continuous bending moment exists on each of the bases of the columns when the trussed girder receives a wind load or a superimposed load. The base construction is therefore uneconomical.

Accordingly, a trussed girder, described in Japanese Patent Application No. 63-129221 (Publication No. 1-299943), U.S. patent application Ser. No. 356,442, U.K. Patent Application No. 8911966.3, is proposed. (The U.S. and U.K. Applications are based on the Japanese Application.)

The structure disclosed in the above patent applications comprises a trussed girder interconnecting between columns, and a pre-tensioned steel cable disposed within and along the trussed girder. The trussed girder includes a pair of upper chord members and a lower chord member, therefore said girder is of a reversed triangle cross section. The ends of the pre-tensioned steel cable are fixed to the columns. The medium portion of the pre-tensioned steel cable is fixed to the lower chord member which is below the ends of the pre-tensioned steel cable. By virtue of the pre-tensioned steel cable, the trussed girder receives an upward thrust force. When introducing the prestress to the pre-tensioned steel cable, first the upper chord members are disposed on but not fixed to the columns. Then, the upper chord members are fixed to the columns to produce a rigid rahmen structure. The columns and the trussed girder cooperate to resist a superimposed load which may occur for a short time (for example, earthquakes, snows, hurricanes, or the like).

With such a three dimensional structure, a sufficient out-of-plane strength is achieved so that the lower chord member is prevented from buckling. Consequently, a large span structure can be produced. In addition, the pre-tensioned steel cable can be disposed in an optional manner so that the cross sectional area of the trussed girder is decreased.

However, the structure still has problems as follows: Since the trussed girder is of a reversed triangle cross section, the arrangement of the lower chord member and lattice members is complicated, so that the construction process is troublesome. Moreover, the chord members, when spanning between the columns, may become unstable.

SUMMARY OF THE INVENTION

It is therefore an object of the present invention to provide a trussed structure which enables to improve the workability of the construction process and to enhance the stability of chord members when spanning between columns.

With this and other objects in view, one aspect of the present invention is directed to a trussed structure including at least a first trussed girder and a second trussed girder. Each of the trussed girders includes an upper chord member, a lower chord member disposed under the upper chord member, and lattice members joining the upper chord member and the lower chord member. Each trussed girder has a first end portion and a second end portion. The first end portions are fixed to a first side of the trussed structure, and the second end portions are fixed to a second side of the trussed structure spaced from the first side, so that the trussed girder span between the first and second sides. The first and second sides includes a plurality of columns. The trussed structure comprises at least a pair of prestressing members. Each of the prestressing members has opposite end portions and a central portion. The pair of prestressing members span between the first and second sides in such a manner that the end portions of the prestressing members are fixed to the columns. The central portions of the prestressing members are disposed below the end portions of the prestressing members, and are connected to the lower chord members so as to pull the lower chord members upwardly. The central portions of both of the prestressing members are disposed between the adjacent first and second trussed girders.

Preferably, the pair of prestressed members cooperate to form a generally X shape in plane view between the adjacent first and second trussed girders.

In more detail, the end portions of each of the prestressing members are fixed to the columns at the opposite end portions of the first trussed girder and the second trussed girder, respectively whereby the pair of prestressing members cross each other at the central portions thereof.

More preferably, the pair of prestressing members are disposed symmetrically so that the said pair of prestressing members pull the lower chord members upwardly with a balanced force.

A connecting member may span between central portions of the lower chord members of the adjacent pair of the trussed girders. The central portions of the prestressing members are slidably disposed on the connecting member.

In another preferred form, the end portions of one of the prestressing members are fixed to the columns at the opposite sides of one of the trussed girders, and the end portions of the other of the prestressing members are fixed to the columns at the opposite sides of the another of the trussed girders. The central portions of the prestressing members are disposed between the adjacent pair of the trussed girders.

DETAILED DESCRIPTION OF THE PREFERRED EMBODIMENTS

With reference to the accompanying drawings, preferred embodiments of the present invention will be described in detail in the following.

First Embodiment

Figure 3:
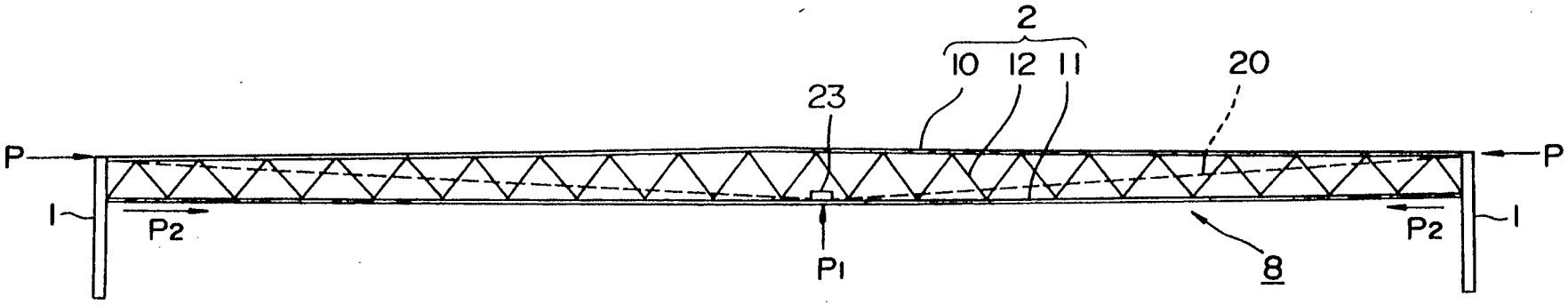
FIG. 3 is a side view of the trussed structure in FIG. 1.
Figure 4:
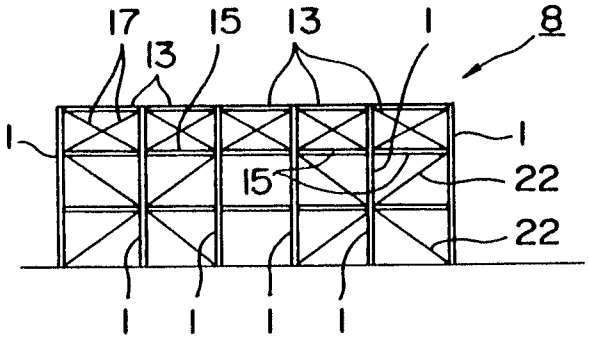
FIG. 4 is a front view of the trussed structure in FIG. 1.
Figure 5:
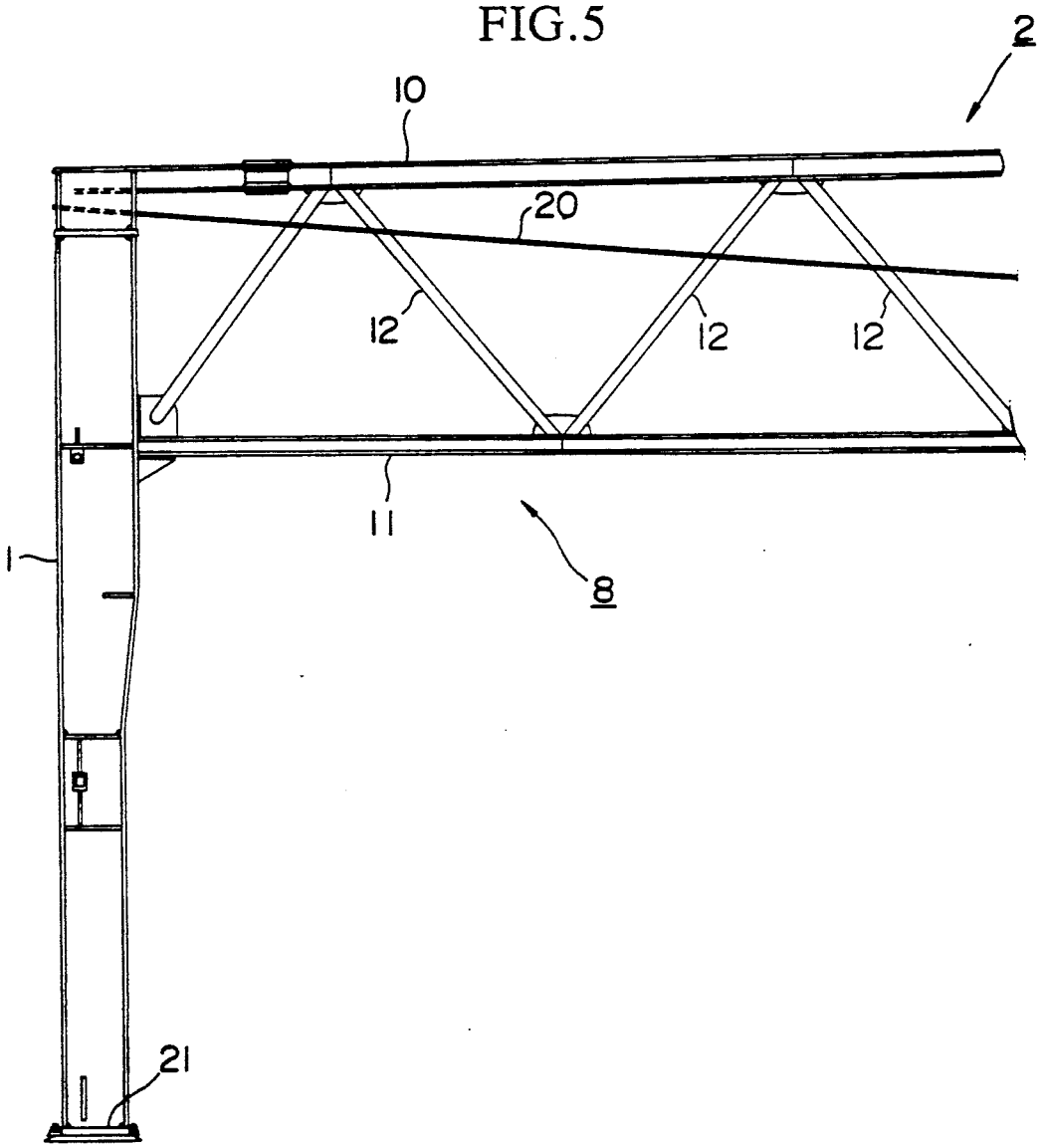
FIG. 5 is an enlarged side view of a part of the trussed structure, showing a connecting portion connecting a column and a trussed girder.

FIGS. 1 through 6 and 9 depict a horizontal trussed steel roof framing or trussed structure 8 which spans between vertical structural columns 1. The columns 1 are disposed at the opposite sides of the trussed structure 8 and form outer walls of a building. As best shown in FIG. 5, each of the column 1 is erected rigidly on a foundation 21 in the ground.

Figure 1:
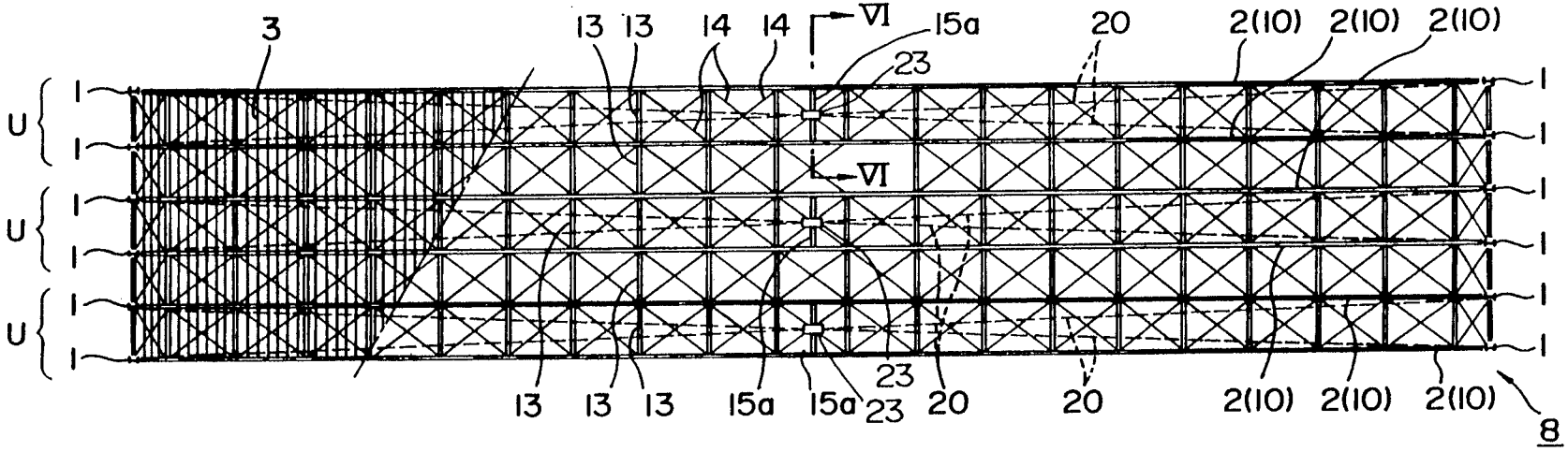
FIG. 1 is a top view of a trussed structure in accordance with a first embodiment of the present invention, showing upper chord members.

As shown in FIG. 1, a plurality of roof panels 3 are mounted on the trussed roof structure 8 so as to produce an entire completed roof. However, the illustration of the panels 3 are partially omitted in FIG. 1.

The trussed roof framing 8 comprises six trussed girders 2. Each of the trussed girders 3 is jointed to adjacent trussed girders 2. Each of the trussed girders 2 spans between the columns 1 at the opposite sides of the trussed framing 8 along the transverse direction in FIGS. 1 through 3. The trussed girders 2 are disposed parallel to one another, and spaced at a uniform interval.

FIGS. 3 and 5 illustrate more detailed joint structure of the trussed girders 2. Each of the trussed girders 2 comprises an upper chord member 10 and a lower chord member 11. The lower chord member 11 is disposed under the upper chord member 10, and generally parallel to the upper chord member 10. The upper chord member 11 is arched to be slightly convex upwards. The upper and lower chord members 10 and 11 are made of wide flange I-beams. In each trussed girder 2, a plurality of pipe lattice members 12 fixedly joint the upper chord member 10 to the lower chord member 11 in a conventional manner.

Figure 2:
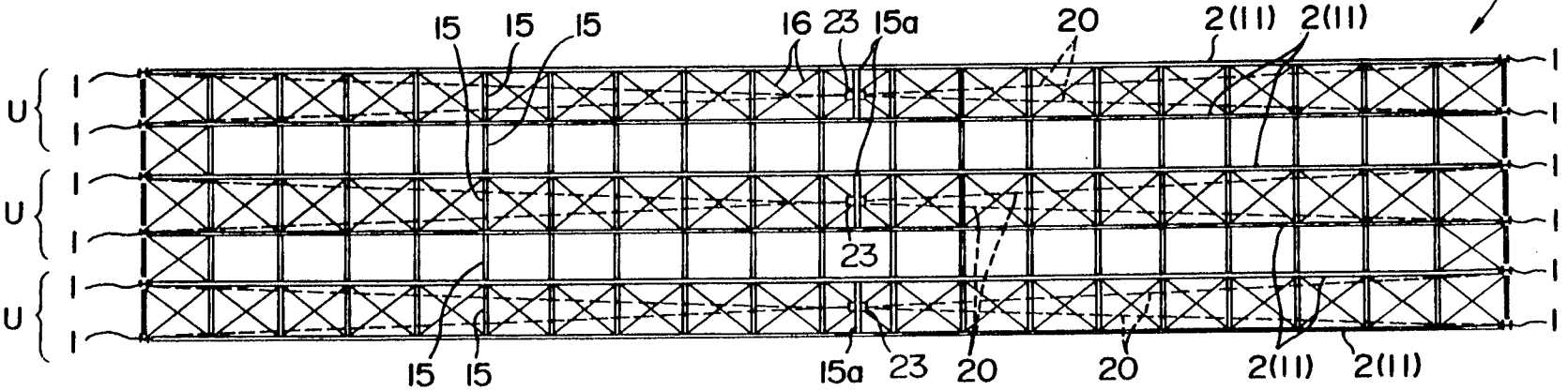
FIG. 2 is a bottom view of the trussed structure in FIG. 1, showing lower chord members.

As illustrated in FIG. 1, the upper chord members 10 of trussed girders 2 are connected through horizontal connecting beams 13, and adjacent upper chord members 10 are connected through bracings 14. As shown in FIG. 2, the lower chord members 11 of trussed girders 2 are also connected through horizontal connecting beams 15, and adjacent upper chord members 10 are connected through bracings 16. The connecting beams 13 and 15 are disposed along the transverse direction of the upper and lower chord members 10 and 11, respectively.

In this embodiment, wide flange I-beams are used for the upper chord members 10 and the lower chord members 11. For the lattice members 12, steel pipes are used. However, more inexpensive parts, for example, T-shaped beams may be used for the chord members 10 and 11. Angle iron beams may be used for the lattice members 12. In addition, wide flange I-beams are used as the columns 1, connecting beams 13 and 15, but other parts may be used instead.

As best shown in FIGS. 3 and 5, the end portions of the upper chord members 10 of the girders 2 are connected directly and rigidly to the upper ends of the columns 1, and the end portions of the lower chord members 11 are connected directly and rigidly to the columns 1. The rigid connection between the chord members 10, 11 and the columns 1 is achieved by a conventional manner, for example, bolts and nuts, or rivets.

Figure 6:
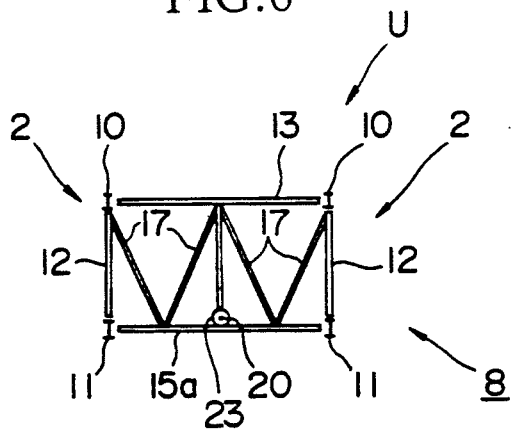
FIG. 6 is a simplified cross sectional view of a trussed along line VI—VI in FIG. 1.

Additionally, the upper and lower connecting beam 13 and 15 are jointed through a plurality of lattice members 17 as shown in FIGS. 4 and 6. The columns 1 at the same side are jointed through bracings 22 as shown in FIG. 4.

Figure 9:
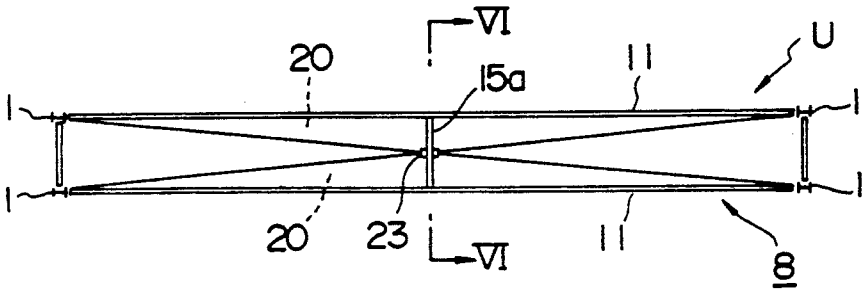
FIG. 9 is a simplified top view of a trussed structural unit U in FIG. 1, showing upper chord members, wherein representation of elements is partially omitted.

A pair of pre-tensioned cables or prestressing members 20 are disposed between the adjacent trussed girders 2 as best shown in FIG. 9. Each of the pre-tensioned cables 20 spans between the opposite sides of the trussed framing 8. The end portions of each of the pre-tensioned cables 20 are fixed to the columns 1 on a diagonal of a quadrangular unit U which is formed by the adjacent trussed girders 2. The pair of pre-tensioned cables 20 between the adjacent trussed girders 2 cross each other to form an X-shape in plane view at the central portion of the cables 2. This crossing portion of the pre-tensioned cables 20 is disposed at the center of the quadrangle formed by the adjacent trussed girders 2.

The cables 20 are bent to convex downwards in such a manner that the central portion of said cable 20 is disposed below the end portions of said cable 20 as shown in FIG. 3. That is, the end portions of each of the cables 20 are connected to the upper ends of the columns 1. In addition, between the adjacent trussed girders 2, the central portion of each of the cables 20 is slidably passed through a sheath 23 mounted on a lower connecting beam **15*a* shown in FIGS. 1, 2, 6, and 9. The connecting member 15*a* is one of said lower connecting beams or connecting member 15, which is disposed at the center line of the trussed structure 8, along the transverse direction of the trussed girders 2 as shown in FIGS. 1 and 2. The sheath 23 is stationarily mounted on the center of the connecting beam 15*a*. Accordingly, the cables 20 form the diagonal of the quadrangle formed by the adjacent trussed girders 2**.

The cables 20 between the adjacent girders 2 are stretched under a predetermined tension P. In each of the units U, the cables are stretched with a balanced force. By virtue of the above arrangement of the pretensioned cables 20, a shearing upward force $P_1$ is exerted on the adjacent pair of trussed girders 2. In addition, a compression force $P_2$ is exerted on the adjacent pair of trussed girders 2 along the lengthwise direction.

The above roof structure 8 is constructed in the following manner.

First of all, the columns 1 are erected on the bases 21 at a predetermined positions. Next, the trussed girders 2 are constructed on the ground. Then, three framework units U, each of which is constituted of a pair of said trussed girders 2 and the bracings 14 and 16, are assembled as illustrated in FIG. 9.

The framework units U are lifted by a pair of cranes disposed at the opposite sides of the trussed framings 8, conveyed between the opposite sides, then attached to the columns 1 as shown in FIG. 1. In this operation, first, the lower chord members 11 are rigidly fixed to the columns 1. Next, the connecting beams 15 and 15*a* are fixed to the lower chord members 11. Then, the cables 20 are passed through the sheath 23 and are arranged to form the X-shape. Then, the end portions of the cables 20 are rigidly fixed to the upper ends of the columns 1, under the tension P. After that, the upper chord members 10 are rigidly fixed to the upper ends of the columns 1.

Then, the bracings 14 and 16 are connected between the adjacent units U. The upper connecting beams 13 are also fixed to the upper chord members 10. The bracings 22 are connected to the columns 1. At last, the trussed structure 8 is covered with the roof panels 3 to finish the roof.

With such a structure, the trussed roof framing 8 presents the following effects and advantages.

Since each of the framework units U is constituted of a pair of parallel trussed girders 2, the cross section is quadrangle shape. Accordingly, the freedom of the arrangement of the necessary parts of the structure is improved. For example, it is unnecessary to dispose the cables 20 in the vicinity of the chord members nor along the chord members.

Moreover, since the arrangement of the cables 20 is not affected by the upper and lower chord members 10 and 11, parts of whatever cross sections can be utilized for the chord members and the cables 20 can be easily positioned at suitable locations.

Furthermore, since the cables 20 are fixed to the columns 1 not to the chord members, the chord members are decreased in their cross section, and light chord members can be used. The bases or foundations of the structure 8 can be more simplified. These effects are especially advantageous for so-called super-wing construction which is considered unsuitable for constructions having spans of 40 to 70 m. The structure of the present invention can be used for such long spans of 40 to 70 m, moreover, used for long spans greater than 70 m economically.

By virtue that the upper and lower chord members 10 and 11 are disposed generally parallel in each of the trussed girder 2, the arrangement of and the joint of the lattice members 12 to the chord members are arranged easily. As mentioned before, more inexpensive parts, for example, T-shaped beams may be used for the chord members 10 and 11. Angle iron beams may be used for the lattice members 12. Therefore, it is possible to reduce the weight of the structure, and cost performance can be enhanced.

Since the above-mentioned shearing force $P_1$ affects on the trussed girders 2 upwardly, a moment caused by the force $P_1$ diminishes the moment by the own weight of the roof framing 8. Tension force and the compression force are applied into the upper chord members 10 and the lower chord members 11, respectively. The shearing force $P_1$ is distributed to each of the trussed girder 2 with the value of $P_1/2$ since the cables 20 is disposed symmetrically between the pair of girder 2. The compression force $P_2$ helps to diminish the effect by the own weight of the roof framing 8. Accordingly, the upper chord members 10, the lower chord members 11, and the lattice members 12, of small cross sections may be employed, so that the cost performance is enhanced.

The value of the compression force $P_2$ is greater than in the conventional structure in which the cables are fixed to the chord members directly. $P_2$ is given by the following formula:

$$P_2 = P + (3PD/2h)$$

where P is said tension force, D is the depth of the trussed girder 2 (distance between the upper end of the upper chord member 10 and the lower end of the lower chord member 11), and h is the height of the trussed girder 2 (distance between the lower chord member 11 and the bottom of the column 1). Hence, the compression force $P_2$ is greater than the introduced tension P. Accordingly, the introduced tension force P can be smaller than that in the conventional trussed structure, and the cables can be decreased in their cross section.

Furthermore, bending moment is occurred in the columns 1 permanently. At the base 21 of the column 1, a moment M in the following formula exists:

$$M = PD/2$$

This moment M diminishes a moment on the bases 21 at the windward sides when the columns 1 receive a strong wind. Consequently, the bases or foundations of the structure can be simplified. On the contrary, a moment is added to the bases 21 at the leeward sides, but the leeward moment is negligibly small in comparison with the windward moment.

As described above, the trussed structure provides the workability of the construction process and to enhance the stability of the chord members when spanning between columns. In addition, the cost performance is enhanced.

In the above description, the trussed structure 8 is used for a roof framing. However, it is not intended to limit the present invention to the above embodiment. For example, the trussed structure of the present invention may be used for bridges and any other buildings other than the roof framing.

Second Embodiment

Figure 7:
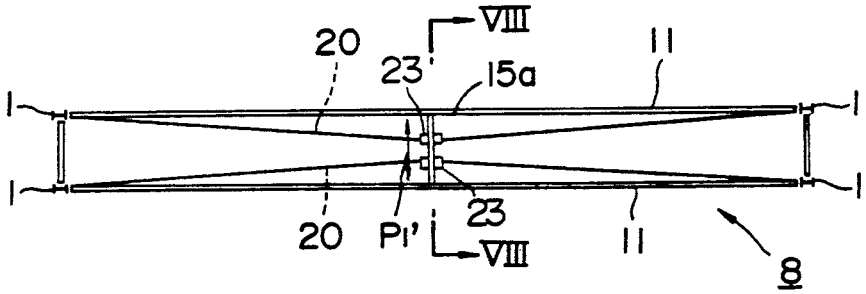
FIG. 7 is a simplified top view of a trussed structural unit U in accordance with a second embodiment of the present invention, showing upper chord members, wherein representation of elements is partially omitted.
Figure 8:
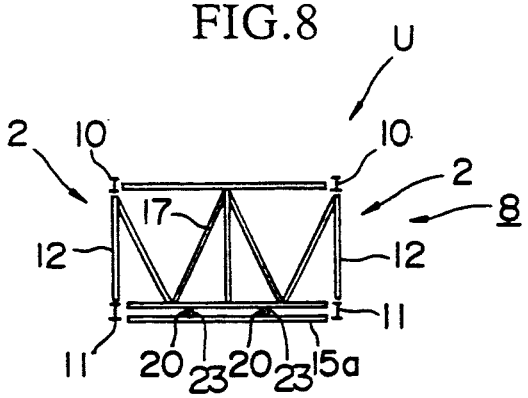
FIG. 8 is a simplified cross sectional view of the trussed structural unit taken along line VIII—VIII in FIG. 7.

FIGS. 7 and 8 depict a modification of the trussed structure embodying the present invention. A structural unit U is represented alone, but the units U may be assembled to form a wide trussed structure like the structure 8 in the foregoing embodiment. In FIGS. 7 and 8, the arrangement of the pre-tensioned cables 20 is different from that of the first embodiment.

As shown in the FIGS. 7 and 8, the cables 20 form a generally X-shape, but do not cross each other. The end portions of each of the cables 20 are connected columns 1 at the opposite sides which are fixed to the same girder 2. Between the pair of trussed girders 2, the central portions of the cables 20 are disposed adjacent to each other. Two sheaths 23, which are as similar to the sheath 23 in the first embodiment, are mounted on the connecting beam 15 in a symmetrical manner. The cables 20 are passed through the sheaths 23.

In this structure, components $P_1'$ of the shearing force $P_1$, along the connecting beam 15*a* is balanced. Thus, undesirable problem, e.g., high bending or shearing stress do not occur.

What is claimed is:

1. A trussed structure including at least a first trussed girder and a second trussed girder each of which includes an upper chord member, a lower chord member disposed under the upper chord member, and lattice members joining the upper chord member and the lower chord member, each trussed girder having a first end portion and a second end portion, the first end portion being fixed to a first side of the trussed structure, the second end portion being fixed to a second side of the trussed structure spaced from the first side, so that the trussed girder span between the first and second sides, the first and second sides including a plurality of columns, comprising:

at least a pair of prestressing members each of which has opposite end portions and a central potion, the pair of prestressing members spanning between the first and second sides in such a manner that the end portions of the prestressing members are fixed to the columns, the central portions of the prestressing members being disposed below the end portions to the prestressing members and connected to the lower chord members so as to pull the lower chord members upwardly, wherein the central portions of both of the prestressing members are disposed between the adjacent first and second trussed girders and the pair of prestressed members cooperate to form a general X-shape in plan view between the adjacent first and second trussed girders.

2. A trussed structure including at least a first trussed girder and a second trussed girder each of which includes an upper chord member, a lower chord member disposed under the upper chord member, and lattice members joining the upper chord member and the lower chord member, each trussed girder having a first end portion and a second end portion, the first end portion being fixed to a first side of the trussed structure, the second end portion being fixed to a second side of the trussed structure spaced from the first side, so that the trussed girder span between the first and second sides, the first and second sides including a plurality of columns, comprising:

at least a pair of prestressing members each of which has opposite end portions and a central potion, the pair of prestressing members spanning between the first and second sides in such a manner that the end portions of the prestressing members are fixed to the columns, the central portions of the prestressing members being disposed below the end portions to the prestressing members and connected to the lower chord members so as to pull the lower chord members upwardly, wherein the central portions of both of the prestressing members are disposed between the adjacent first and second trussed girders and the end portions of each of the prestressing members are fixed to the columns at the opposite end portions of the first trussed girder and the second trussed girder, respectively whereby the pair of prestressing members cross each other at the central portions thereof.

3. A trussed structure as recited in claim 2, wherein the pair of prestressing members are disposed symmetrically so that the said pair of prestressing members pull the lower chord members upwardly with a balanced force.

4. A trussed structure as recited in claim 2, wherein a connecting member spans between central portions of the lower chord members of the adjacent pair of the trussed girders, the central portions of the prestressing members being slidably disposed on the connecting member.

5. A trussed structure as recited in claim 1, wherein the end portions of one of the prestressing members are fixed to the columns at the opposite sides of one of the trussed girders, and the end portions of the other of the prestressing members are fixed to the columns at the opposite sides of the another of the trussed girders, the central portions of the prestressing members being disposed between the adjacent pair of the trussed girders.

6. A trussed structure as recited in claim 5, wherein the pair of prestressing members ar disposed symmetrically so that the said pair of prestressing members pull the lower chord members upwardly with a balanced force.

7. A trussed structure as recited in claim 5, wherein a connecting member spans between central portions of the lower chord members of the adjacent pair of the trussed girders, the central portions of the prestressing members being slidably disposed on the connecting member.

* * * * *